US011447289B1

(12) United States Patent
Mehta et al.

(10) Patent No.: US 11,447,289 B1
(45) Date of Patent: Sep. 20, 2022

(54) COLLAPSIBLE CONTAINER

(71) Applicant: Amazon Technologies, Inc., Seattle, WA (US)

(72) Inventors: Kaushal Mehta, Seattle, WA (US); Travis James Englert, Brea, CA (US); Sydney Ogawa Garcia, Huntington Beach, CA (US); Suzanne Clark Ward, Santa Monica, CA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 16/219,721

(22) Filed: Dec. 13, 2018

(51) Int. Cl.
*B65D 21/02* (2006.01)
*B65D 6/18* (2006.01)

(52) U.S. Cl.
CPC ..... *B65D 11/1846* (2013.01); *B65D 21/0212* (2013.01)

(58) Field of Classification Search
CPC . B65D 11/1846; B65D 11/18; B65D 11/1893; B65D 11/1866; B65D 7/26; B65D 7/28; B65D 9/18; B65D 9/14; B65D 9/12
See application file for complete search history.

(56) References Cited

U.S. PATENT DOCUMENTS 2,780,381 A * 2/1957 Coit, Jr. ..... B65D 19/12 220/6
3,164,281 A * 1/1965 Williams, Jr. ..... B65D 7/26 217/14
4,498,598 A * 2/1985 Bae ..... B65D 11/1846 217/14
4,820,383 A * 4/1989 Shchamorov ..... B65D 11/1846 220/6
5,458,255 A * 10/1995 Addeo ..... B65D 11/1853 220/6
2014/0326720 A1* 11/2014 Probst ..... F24C 1/16 220/6
2017/0079426 A1* 3/2017 Davis ..... B65D 21/0212

* cited by examiner

*Primary Examiner* — Don M Anderson
(74) *Attorney, Agent, or Firm* — BakerHostetler

(57) ABSTRACT

A collapsible container includes rigid sidewalls and end walls that are hinged together and a rigid bottom wall that is hinged to one of the sidewalls. A short leg on an end of each of the sidewalls gives the sidewall a L-shape (when viewed from above). Hinges formed on distal ends of the legs enable the bottom wall to fold against an inboard surface of one of the sidewalls, and enable one of the end walls to lie flat to conserve volume for shipping multiple containers in the collapsed configuration.

20 Claims, 8 Drawing Sheets

COLLAPSIBLE CONTAINER

BACKGROUND

The present invention relates to containers, and more particularly to re-useable containers that are capable of collapsing.

In modern order fulfillment centers and warehouses, a large number of containers, such as totes and the like, are used to hold and transport products. The containers hold products in the manufacturers packaging, hold items that are already packaged into a box, mailer, or other packaging, and the like. Containers for order fulfillment centers and like warehouses are provided in many sizes.

Often, containers holding products are transported within the fulfillment center or other warehouse, and then stacked on pallets for transporting to another warehouse, such as another fulfillment center or a sort center for arranging further transport.

Hinges on containers, such as hinged container lids, are formed having the barrel portions, typically referred to as nodes or loops, formed integrally with the plastic walls.

DETAILED DESCRIPTION OF ILLUSTRATIVE EMBODIMENTS

Figure 1:
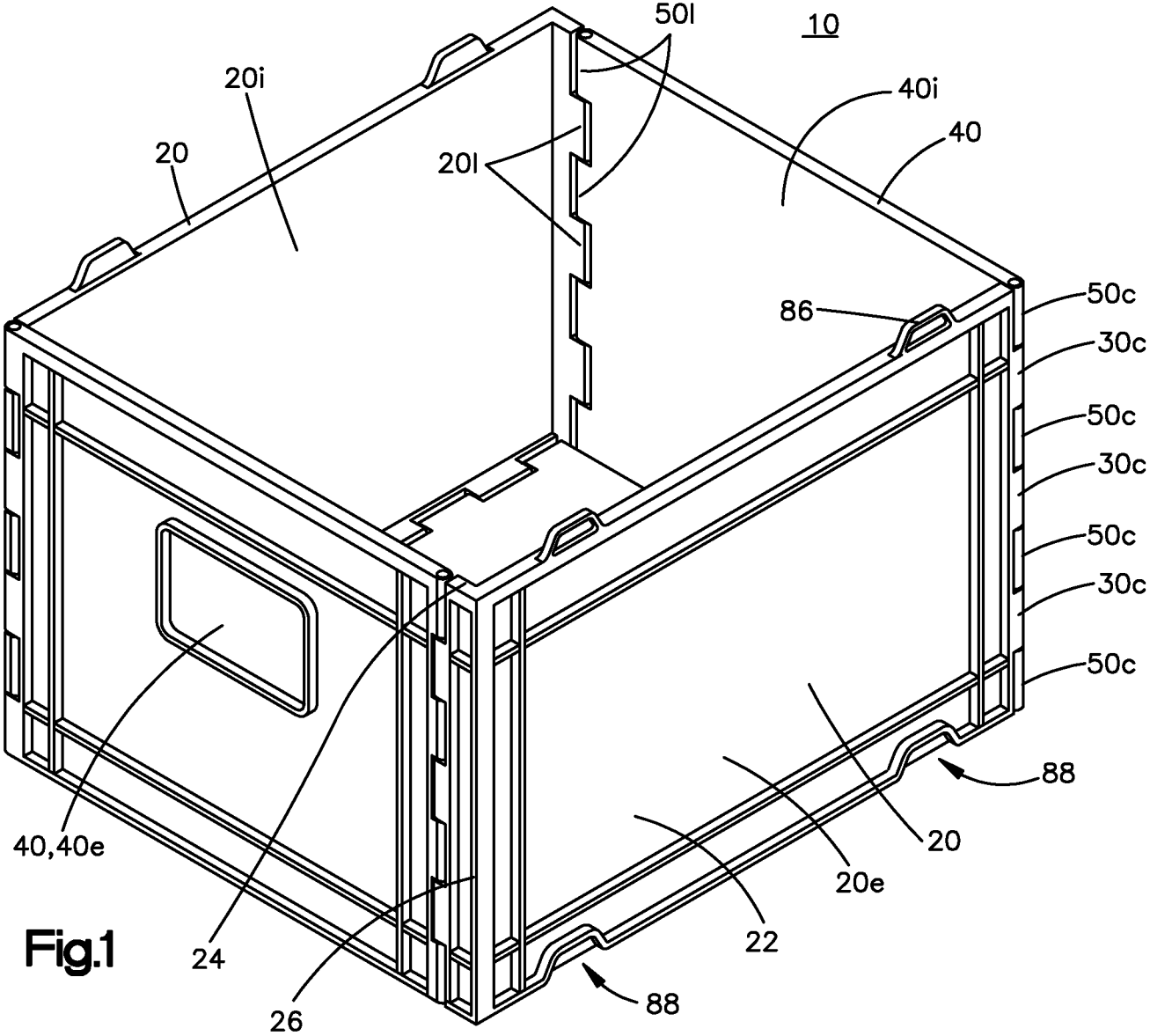
FIG. 1 is a perspective view of a collapsible container in the assembled configuration.
Figure 2:
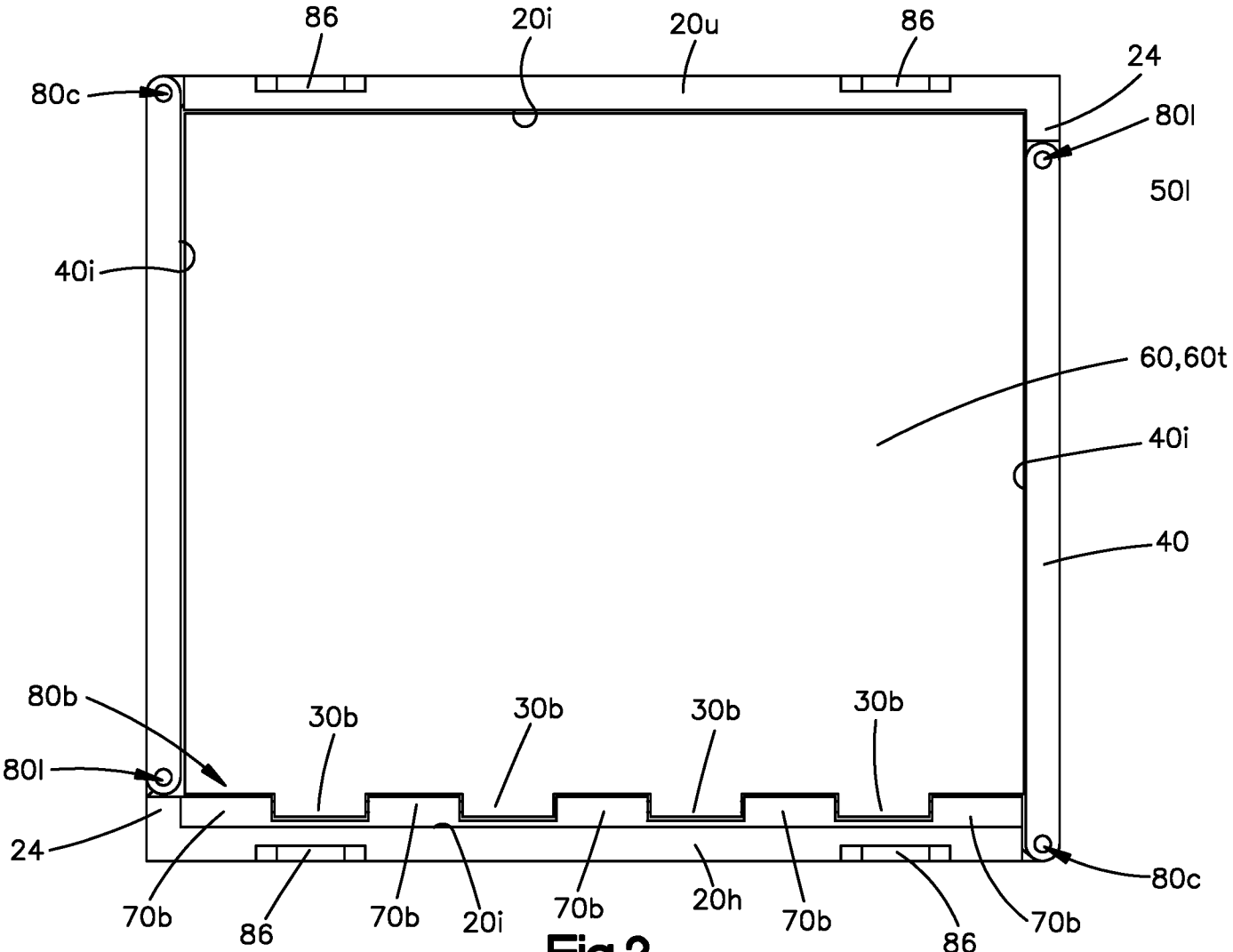
FIG. 2 is top view of the container of FIG. 1.
Figure 3:
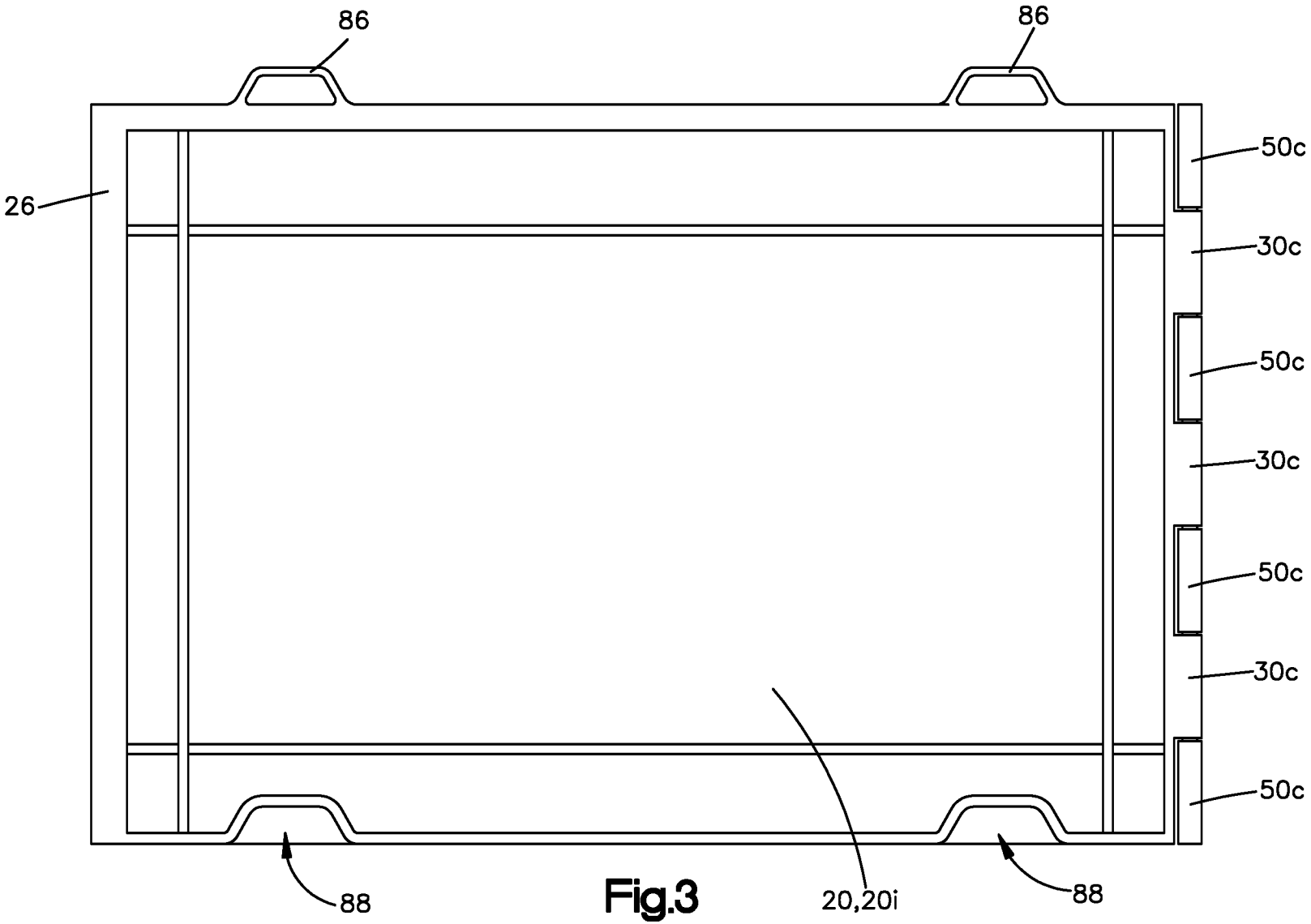
FIG. 3 is a side view of the container of FIG. 1.
Figure 4:
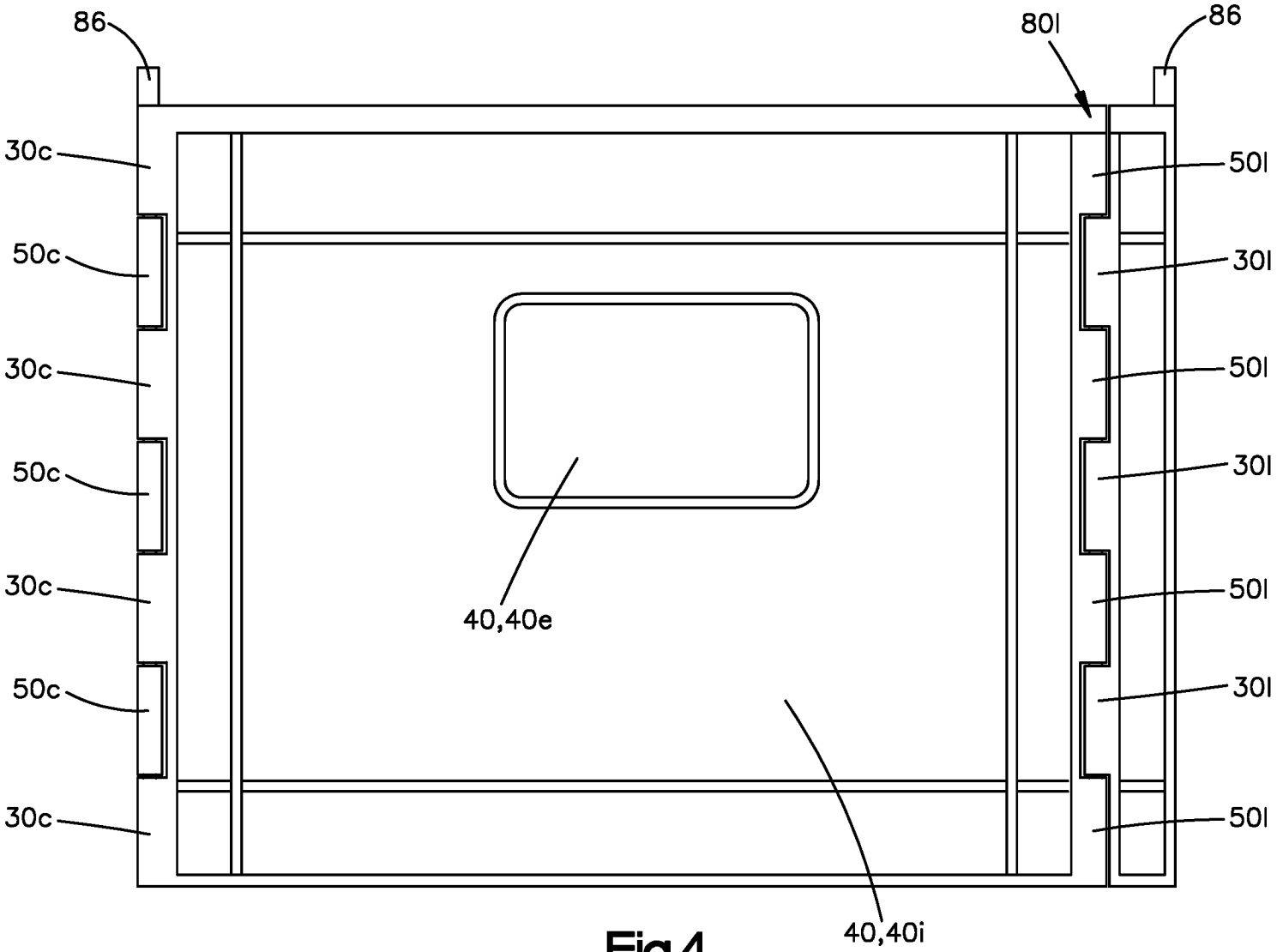
FIG. 4 is an end view of the container of FIG. 1.
Figure 5:
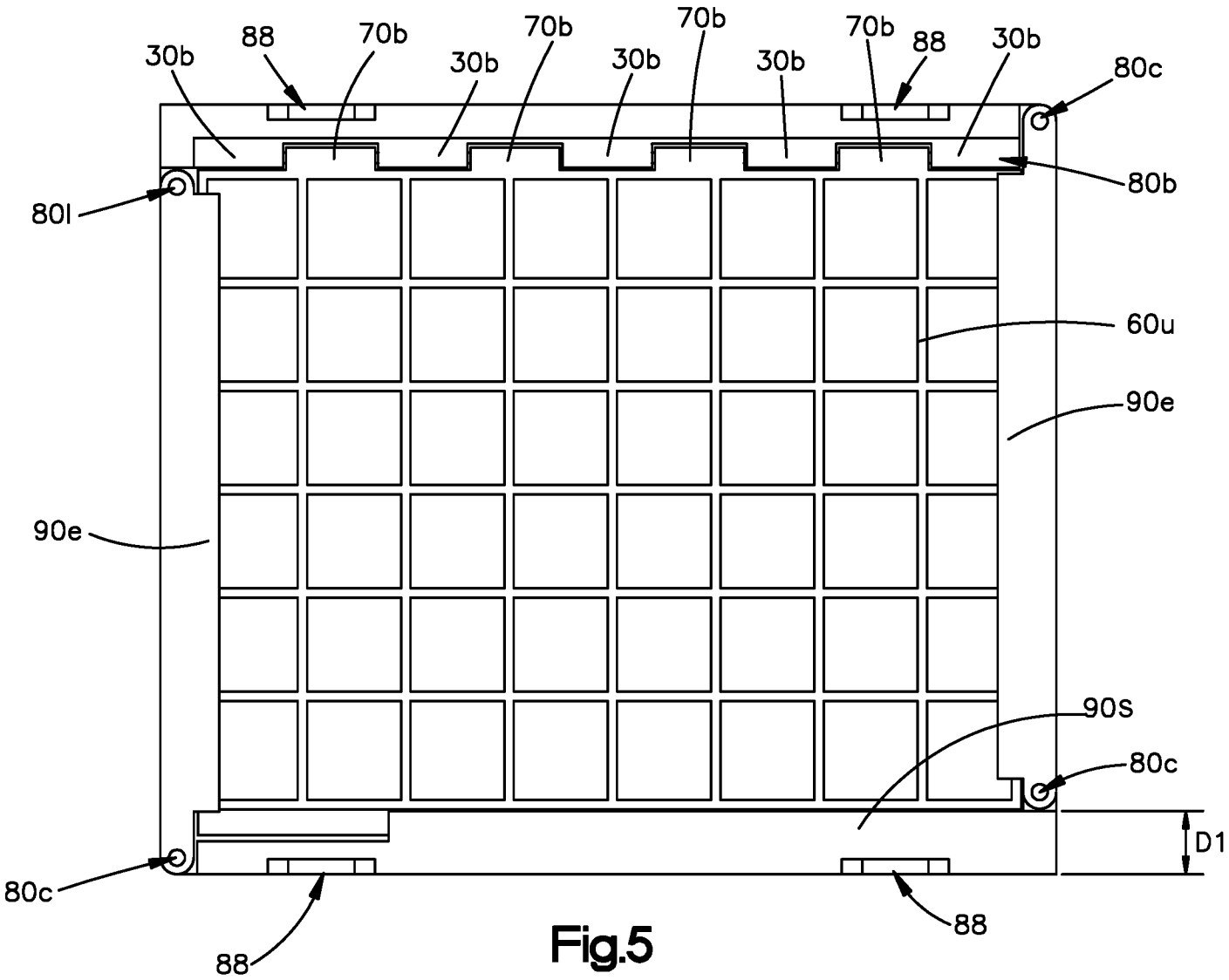
FIG. 5 is a bottom perspective view of the container of FIG. 1.
Figure 6:
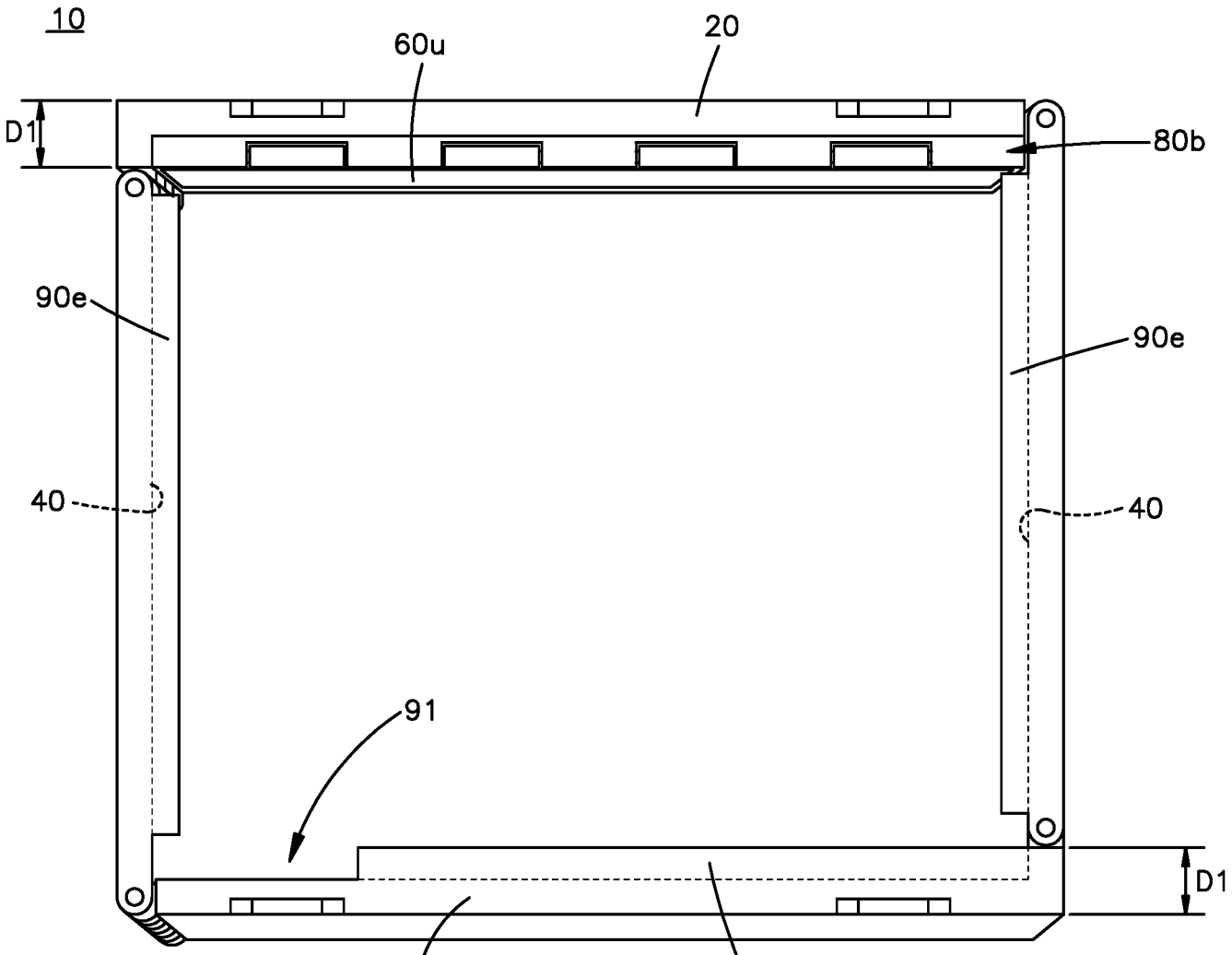
FIG. 6 is a bottom of the container during the collapsing process.

Referring to the figures, a container 10 has an assembled configuration in which the container is useable as a container for holding items such as commercial products in the manufacturers' packaging, or products that are in paperboard boxes or soft-sided mailers. Container 10 includes a pair of opposing sidewalls 20, a pair of opposing ends walls 40, and a bottom wall 60.

Each sidewall 20, which is also referred to as a first wall, includes a main wall portion 22 and a leg 24 such that sidewall 20 has an L-shaped in top view. Main wall 22 and leg 24 are rigid and form a rigid corner 26. Each end wall 40, as illustrated in the figures, is rigid and flat.

Hinge nodes 30L extend from a distal end of leg 24. Hinge nodes 50L extend from the leg-side of end wall 40. Sidewall-hinge nodes 30L and end wall-hinge nodes 50L alternate and extend the entire height of legs 24 and end wall 40 to form leg-hinge 80L. A pin (not shown in the figures) extends longitudinally through nodes 30L and 50L. Each node 30L and 50L extends from the corresponding wall body and has a curved, such as a semi-circular, distal end to enhance actuation of the hinges.

Hinge nodes 30C form a distal end of the main wall portion 22 opposite the leg 24, which is referred to herein as the corner-side of wall 20 and main wall portion 22. Hinge nodes 50C form a distal end of the end wall 40 opposite the leg-side, which is referred to as the corner-side of end wall 40. Hinges nodes 30C and 50C alternate and extend the entire height of main wall portion 22 and end wall 40 to form corner hinge 80C. A pin (not shown in the figures) extends longitudinally through nodes 30C and 50C. Each node 30C and 50C extends from the corresponding wall body and has a curved, such as a semi-circular, distal end to enhance actuation of the hinges.

Bottom wall 60 is formed of a rigid polymer, such as high-density polyethylene or like engineering polymer. Preferably, stiffening ribs support the walls, as illustrated in the figures. The stiffening ribs can be of any shape, location, thickness, and height. Each sidewall 20 includes an inboard surface 20*i* and an exterior or outboard surface 20*e*. End wall 40 includes an inboard surface 40*i* and an exterior or outboard surface 40*e*. Bottom wall 60 includes a topside or inboard surface 60*t* and an underside surface 60*u*.

Hinge nodes 70B form an end of one long side of bottom wall 60. The long side of bottom wall 60 is referred to herein as the free-side or the rib-side. Hinge nodes 30B extend perpendicularly from a lower portion of the inboard surface 20*i* and each has a curved, such as a semi-circular, distal end to enhance actuation of the hinges. Node 70B extends from the corresponding bottom wall body and has a curved, such as a semi-circular, distal end to enhance actuation of the hinges. Hinge nodes 30B and 70B alternate and extend the entire length of bottom wall 60 to form bottom hinge 80B. A pin (not shown in the figures) extends longitudinally through nodes 30B and 70B. Node 70B extends from the corresponding bottom wall body and has a curved, such as a semi-circular, distal end to enhance actuation of the hinges.

The sidewall 20 having nodes 30*b* is referred to the hinged sidewall or the hinged-one of the sidewalls 20. The opposing sidewall 20 is referred to as the unhinged sidewall or the unhinged-one of the sidewalls 20. Reference numbers U and H are appended to reference number 20 when referring to a specific one of the sidewalls, while the reference number 20 is used to refer to either or both of the sidewalls. Likewise, surfaces 20*i*, 20*e*, 40*i*, and 40*e* are used to refer to specific surfaces of walls 20 and 40.

A rib 90S extends perpendicularly from inboard surface 20*i* of unhinged sidewall 20U. When the container is in the assembled configuration, rib 90S has a top surface that is horizontal. A rib 90B extends outwardly from an end face of bottom wall 70. In the embodiment of the figures, a top surface of rib 90B is co-planar with bottom wall topside 70*t*. Rib 90B is an integral part of bottom wall 40, and thus can be considered to extend from a main portion of the bottom wall 40. In the assembled position, bottom wall rib 90B rests on rib 90S of sidewall 20U. Rib 90*s* of the sidewall does not extend all the wall laterally to end wall 20, and thus forms a cutout 96.

At a lower portion of each end wall 40, a rib 90E extends almost the length of the end wall 40. End wall ribs 90E are at a lower vertical position compared with sidewall rib 90S, as end wall ribs 90E contacts and supports the underside 60*u* of the bottom wall, while sidewall rib 90S supports rib 90B of the bottom wall, which extends from the upper portion of the end face. The vertically offset configuration of ribs 90S and 90E enhances collapsing, as the ribs are offset in the collapsed configuration. In this regard, during the collapsing process ribs 90E and 90S bypass one another.

Bottom wall 60, end wall 40, and main wall portion 22 and leg 24 are formed of a rigid polymer, such as high-density polyethylene or like engineering polymer. Preferably, stiffening ribs support the walls on the exterior and bottom, as illustrated in the figures. The stiffening ribs can be of any shape, location, thickness, and height. Other configurations, such as honeycomb structures, torsion box structures, and like structures to form strong, lightweight walls, are contemplated.

Figure 7:
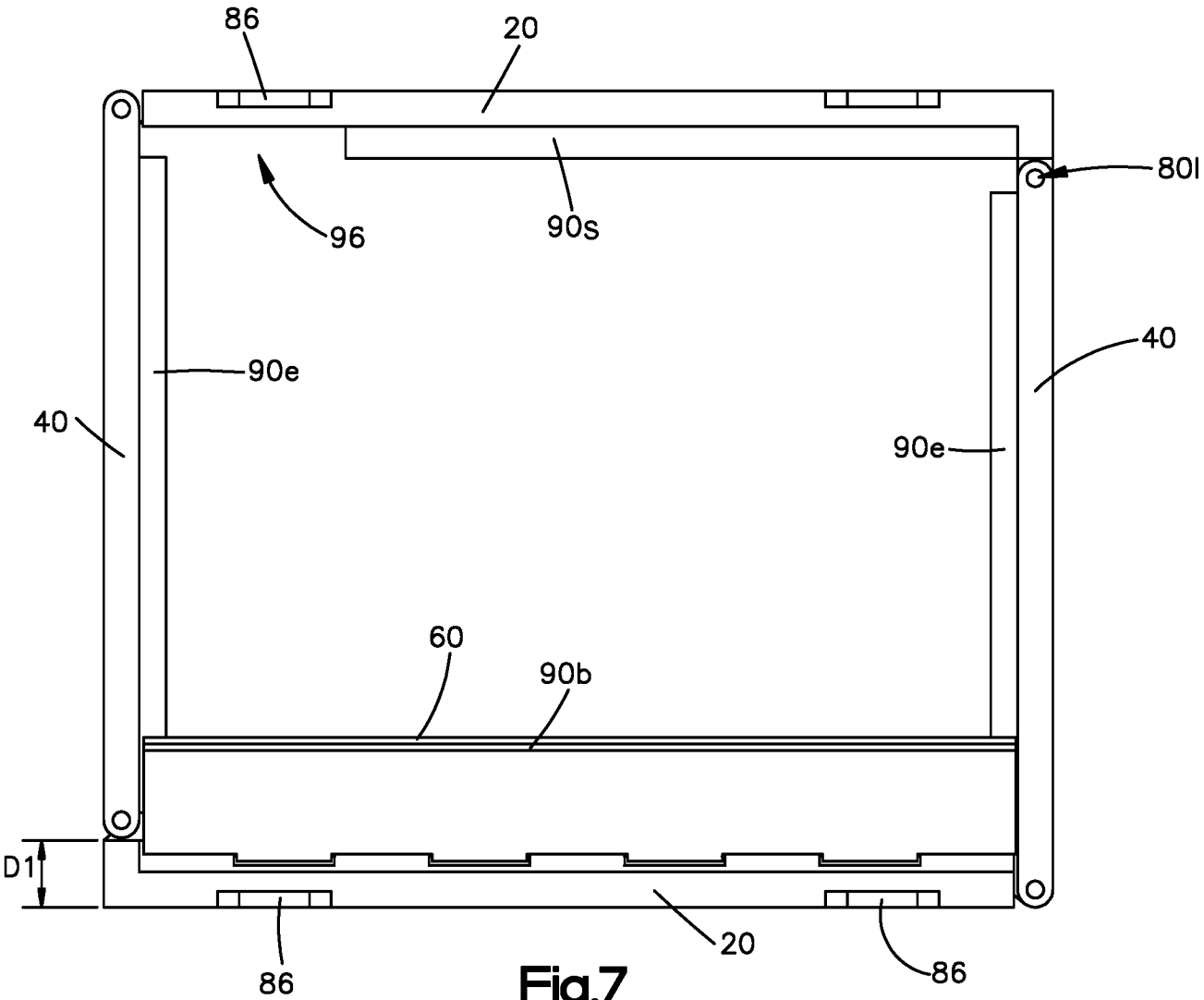
FIG. 7 is a top view of the container during the collapsing process.
Figure 8:
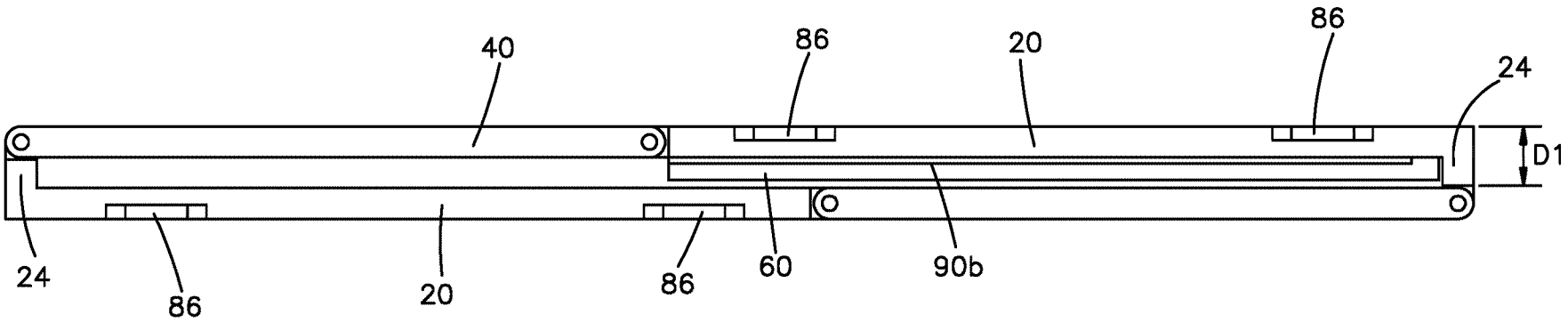
FIG. 8 is a view of the container in the collapsed configuration.

To move container 10 from the assembled configuration of FIGS. 1-5 to the collapsed configuration of FIG. 8, a user or an automated process can put an upward force on the bottom wall underside 60*u* near the free end while the container is empty. In response, bottom wall 60 comes out of engagement with supporting ribs 90E and 90S while pivoting about the bottom hinge defined by bottom hinge 80B (FIG. 7). Bottom wall 60 pivots upwardly until bottom wall topside surface 60*t* contacts and lies against hinged sidewall inner surface 20*i* (FIG. 8). The combined thickness of sidewall 20H and bottom wall 60 is approximately equal to leg dimension D1, which is the dimension from the exterior face 20*e* to the end of the portion of leg 24 from which nodes 30L extend, which is also approximately equal to the leg dimension D1, which is the dimension from surface 20*e* to the distal end of nodes 30L minus the thickness of wall 40 plus clearance within the hinge. The dimensions are such that in the collapsed configuration, the end wall 40 lies flat on the underside 60*u* of bottom wall 60, as illustrated in FIG. 8.

During the collapsing process, the cutout 91 of sidewall rib 90*s* forms a space that receives a portion of the folded-up bottom wall 60, thus enabling sidewall 20*u* to lie on the bottom wall surface 60*u*.

With the bottom wall 60 against sidewall 20H, the walls 20 and 40 are moved in a racking direction (that is, through a parallelogram shape) in a direction in which the leg-hinges 80L decrease in angle from (nominally) 90 degrees to zero degrees. End wall 20 lies on bottom wall surface 60*u* as explained above, an a portion of unhinged sidewall 20*u* also rests on bottom wall surface 60*u* such that the total height of the collapsed container is the thickness of the hinged sidewall 20H plus the thickness of the end wall 20 plus the thickness of the bottom wall 60. The length of the collapsed container is the length of the sidewall 20 plus the length of the end wall 40 minus the height of one of the corner nodes 30C and 50C plus a hinge clearance.

The collapsed configuration enables container 10 to be shipped with a minimum of wasted space.

Each sidewall 20 at an upper edge include ear-like tabs 86 that project upwardly and form the highest part of the container. Corresponding recesses 88 are formed on the bottom edges of each sidewall such that upon stacking, tabs 86 enter into recesses 88 to stabilize the stack and the stacks organized on the pallet. Tabs 86 can also enter into recesses 88 when the containers are organized in their collapsed configuration and loaded onto a pallet, which aids in the density of the containers 10 when shipped back to a fulfillment facility (or the like) for re-use.

The present invention is illustrated employing particular structure and function. The present invention is not limited to the structure and function specifically described herein. Rather, person familiar with the technology will understand variations encompassed by the description. According, it is intended that the claims be given their full scope.

We claim:

1. A collapsible container, comprising:

a pair of opposing, L-shaped rigid sidewalls, each one of the L-shaped rigid sidewalls having a main portion and a leg extending perpendicularly from the main portion at a rigid sidewall corner;

a pair of opposing rigid end walls joined to the L-shaped rigid sidewalls using hinges;

a bottom wall joined to a first one of the L-shaped rigid sidewalls using a hinge at one end of the bottom wall; and a rib extending from a lower portion of a second one of the L-shaped rigid sidewalls that is not hingedly connected to the bottom wall, the rib defining a cutout, wherein the bottom wall is configured to be pivoted relative to the first one of the L-shaped rigid sidewalls about the hinge at the one end of the bottom wall and the L-shaped rigid sidewalls and the rigid end walls are configured to be pivoted about the hinges joining the pair of opposing rigid end walls to the L-shaped rigid sidewalls to collapse the container such that the bottom wall lies between the first one of the L-shaped rigid sidewalls and one of the rigid end walls so that a total height of the collapsible container in a collapsed configuration is equal to a sum of a thickness of the main portion of the first one of the L-shaped rigid sidewalls, a thickness of the bottom wall, and a thickness of the one of the rigid end walls, and wherein the leg of the first one of the L-shaped rigid sidewalls has a length that is less than the total height of the collapsible container in the collapsed configuration.

2. The container of claim 1, wherein a height of the container in the collapsed configuration is equal to at least a sum of a thickness of one of the L-shaped rigid sidewalls, a thickness of one of the rigid end walls, and a thickness of the bottom wall.

3. The container of claim 1, wherein the rib has a length that is less than a length of the main portion of the second one of the L-shaped rigid sidewalls, such that in the collapsed configuration, the rib does not interfere with the bottom wall.

4. The container of claim 1, wherein the L-shaped rigid sidewalls include projected tabs configured to protrude into recesses of another container when the container and the other container are stacked.

5. The container of claim 1, wherein the leg of the first one of the L-shaped rigid sidewalls has a length that is equal to at least a sum of the thickness of the main portion of the first one of the L-shaped rigid sidewalls and the thickness of the bottom wall.

6. A collapsible container, comprising:

a pair of opposing, rigid sidewalls, each sidewall having an L-shape such that each sidewall includes a main wall and a leg rigidly extending from one end of the main wall, the main wall including a corner-side end opposite the leg;

a pair of opposing, rigid end walls, each rigid end wall including a leg-side end and an opposing corner-side end, the rigid sidewalls being longer than the rigid end walls;

L-hinges formed between ends of the sidewall legs and the leg-side ends of the rigid end walls;

corner hinges formed at right angle interfaces between the sidewall corner ends and the end wall corner ends;

a rigid bottom wall having a hinge-side and a free-side;

a bottom wall hinge extending between a hinge side of the rigid bottom wall and a lower portion of a first one of the rigid sidewalls; and at least one rib extending from a lower portion of a second one of the rigid sidewalls opposite the first one of the rigid sidewalls, the rib defining a cutout, wherein the rigid bottom wall is configured to be pivoted approximately 90 degrees toward the first one of the rigid sidewalls about the bottom wall hinge and each one of the rigid end walls and the rigid sidewalls is configured to collapse inwardly around the L-hinges and the corner hinges after pivoting of the rigid bottom wall such that the rigid end walls and the rigid sidewalls lie flat so that a total height of the collapsible container in a collapsed configuration is equal to a sum of a thickness of the main wall of the first one of the rigid sidewalls, a thickness of the rigid bottom wall, and a thickness of one of the rigid end walls, and wherein the leg of the first one of the rigid sidewalls has a length that is less than the total height of the collapsible container in the collapsed configuration.

7. The container of claim 6, wherein the leg of the first one of the rigid sidewalls has a length that is equal to at least a sum of the thickness of the main wall of the first one of the rigid sidewalls and the thickness of the rigid bottom wall.

8. The container of claim 6, wherein each L-hinge includes:

at least one leg-hinge node forming a distal end of the leg, at least one wall-hinge node forming the leg-side end of the rigid end wall, and a pin extending through the at least one leg-hinge node and the at least one wall-hinge node.

9. The container of claim 6, wherein each L-hinge includes:

leg-hinge nodes forming a distal end of the leg, wall-hinge nodes forming the leg-side end of the rigid end wall, and a pin extending through the leg-hinge nodes and the wall-hinge nodes, the wall-hinge nodes alternating with the leg-hinge nodes.

10. The container of claim 6, wherein, in the collapsed configuration, the first one of the rigid sidewalls and a first one of rigid end walls are mutually parallel, the second one of the rigid sidewalls and a second one of the rigid ends walls are mutually parallel, and the rigid bottom wall lies in between the first one of the rigid sidewalls and the second one of the rigid end walls.

11. The container of claim 10, wherein, in the collapsed configuration, the rigid bottom wall rests between an inboard face of the first one of the rigid sidewalls and an inboard face of the second one of the rigid end walls.

12. The container of claim 11, wherein the rigid bottom wall includes a bottom wall rib extending from an upper portion of the rigid bottom wall, the rib and the bottom wall rib being configured to support the rigid bottom wall while the container is in an assembled configuration.

13. The container of claim 6, wherein the rib has a length that is less than a length of the main wall of the second one of the rigid sidewalls, such that in the collapsed configuration, the rib does not interfere with the rigid bottom wall.

14. The container of claim 6, further comprising a pair of end wall ribs, an underside of the rigid bottom wall resting on the end wall ribs in an assembled configuration, and the end wall ribs lying below the rigid bottom wall and below the rib in the collapsed configuration.

15. The container of claim 6, wherein the rigid sidewalls include projected tabs configured to protrude into recesses of another container when the container and the other container are stacked.

16. A method of collapsing the collapsible container of claim 6, the method comprising:

pivoting the rigid bottom wall about the bottom wall hinge until the rigid bottom wall contacts an inboard face of the second one of the rigid sidewalls; and pivoting the rigid sidewalls and the rigid end walls about the corner hinges and the L-hinges such that the container lies flat with the first one of the rigid end walls adjacent an underside of the rigid bottom wall.

17. A method of expanding the collapsible container of claim 6, the method comprising:

pivoting the rigid sidewalls and rigid end walls about the corner hinges and the L-hinges until the corner hinges form a right angle; and pivoting the rigid bottom wall about the bottom wall hinge until the rigid bottom wall is supported by the rib.

18. A collapsible container, comprising:

a first sidewall having a first main portion and a first leg extending perpendicularly from the first main portion;

a second sidewall having a second main portion and a second leg extending perpendicularly from the second main portion;

a first end wall hingedly connected to the first leg of the first sidewall and to the second main portion of the second sidewall;

a second end wall hingedly connected to the second leg of the second sidewall and to the first main portion of the first sidewall;

a bottom wall hingedly connected to the second sidewall;

a first rim extending perpendicularly inward from the first main portion;

a second rim extending perpendicularly inward from the first end wall; and a third rim extending perpendicularly inward from the second end wall, wherein the bottom wall is configured to be pivoted relative to the second sidewall and the first and second sidewalls and the first and second end walls are configured to be pivoted relative to one another to collapse the container such that the bottom wall lies between the second sidewall and the second end wall so that a total height of the collapsible container in a collapsed configuration is equal to a sum of a thickness of the second main portion, a thickness of the bottom wall, and a thickness of the second end wall, and wherein the second leg has a length that is equal to less than the total height of the collapsible container in the collapsed configuration.

19. The container of claim 18, wherein the second leg has a length that is equal to at least a sum of the thickness of the second main portion and the thickness of the bottom wall.

20. The container of claim 18, wherein the first rim defines a cutout and the first rim has a length that is less than a length of the first main portion.

* * * * *